United States Patent [19]

Kuebler

[11] Patent Number: 4,664,380

[45] Date of Patent: May 12, 1987

[54] RACKET HAVING THICKENED SHAFT PORTION

[76] Inventor: Siegfried Kuebler, 17 Mozart St., D 777 Ueberlingen, Fed. Rep. of Germany

[21] Appl. No.: 698,189

[22] Filed: Feb. 4, 1985

[30] Foreign Application Priority Data

Sep. 22, 1984 [DE] Fed. Rep. of Germany ..... 3434956

[51] Int. Cl.[4] ..... A63B 49/02

[52] U.S. Cl. ..... 273/73 C; 273/73 G

[58] Field of Search ..... 273/73 R, 73 C, 73 D, 273/73 F, 73 J, 73 G, 73 H, 73 L, 73 K, 67 B, 326, DIG. 23; D21/212

[56] References Cited

U.S. PATENT DOCUMENTS

| | | | |
|---|---|---|---|
| D. 233,355 | 10/1974 | Foley | D21/212 |
| D. 243,467 | 2/1977 | Kouvelas | D21/212 |
| 2,171,223 | 8/1939 | Robinson | 273/73 H |
| 3,640,533 | 2/1972 | Davis et al. | 273/73 K X |
| 3,647,211 | 3/1972 | Doessel et al. | 273/73 C |
| 3,809,402 | 5/1974 | Haines et al. | 273/73 C |
| 4,291,574 | 9/1981 | Frolow | 273/73 C X |
| 4,293,129 | 10/1981 | Planakis | 273/73 C X |
| 4,322,076 | 3/1982 | Bertram et al. | 273/73 G X |
| 4,438,925 | 3/1984 | Lindstrom | 273/75 |
| 4,440,392 | 4/1984 | Popplewell | 273/DIG. 23 X |

FOREIGN PATENT DOCUMENTS

| | | | |
|---|---|---|---|
| 827983 | 5/1938 | France | 273/73 J |
| 415707 | 8/1934 | United Kingdom | 273/73 J |

*Primary Examiner*—Richard C. Pinkham
*Assistant Examiner*—Matthew L. Schneider
*Attorney, Agent, or Firm*—Bachman & LaPointe

[57] ABSTRACT

A racket for playing a game using a ball of limited resiliency such as a tennis racket comprises a racket head frame portion provided with stringing, a handle, and a shaft arrangement connecting the racket head frame portion and the handle. The resonance frequency of the racket head frame portion at least approximately corresponds to the period of time for which a ball is in contact with the strings of the racket when struck thereby, and the natural frequency of the racket substantially corresponds to the excitation frequency of the ball. The thickness of the racket frame as measured in a direction normal to the plane of the stringing is greater than the thickness of the handle as measured in a corresponding direction.

16 Claims, 13 Drawing Figures

RACKET HAVING THICKENED SHAFT PORTION

BACKGROUND OF THE INVENTION

The invention relates generally to a racket for playing a game with a ball of limited resiliency, such as a tennis racket.

A conventional racket for playing such a ball game comprises a stringing frame portion or racket head, with suitable stringing therein. Adjoining the racket head frame portion is a throat region, which in turn is connected to a handle at the end of the racket remote from the racket head frame portion, by a suitable shaft arrangement. In a conventional tennis racket of that kind, the height of the handle without any cladding or wrapping material thereon, is from 23 to 32 mm while the height of the racket head frame portion is less than the thickness of the handle. The height of the handle and the height of the racket head frame portion are measured in the direction in which a ball is struck by the racket, being therefore measured in a direction which is normal to the plane in which the stringing of the racket lies. A racket of the conventional dimensions referred to above is disclosed for example in German laid-open application (DE-OS) No. 30 18 354.

Experiments have shown, that in tennis rackets of the above-indicated kind, when gripped in the region of the handle thereof, the fundamental natural frequency or inherent frequency of the racket is 25 to a maximum of 50 Hz; unstringed tennis rackets generally have slightly higher values.

When a ball strikes against or is hit by the stringing, it is known that the ball forces the racket head frame portion out of the longitudinal axis of the racket and results in the reliability of aim of the ball being adversely affected, the above-mentioned deflection of the racket head frame portion also being responsible for the direction in which the ball flies.

Due to the different values of the natural frequency of the tennis racket on the one hand and the 'ball resonance' of about 125 Hz on the other hand, it can be shown that deviations of up to a meter from the desired line of flight of the ball occur over the entire length of for example a tennis court. The ball-striking accuracy of such known tennis rackets therefore leaves much to be desired.

SUMMARY OF THE INVENTION

An object of the present invention is to generally improve the ball-striking performance of a racket such as a tennis racket.

Another object of the present invention is to provide a racket such as a tennis racket wherein the deflection and deviation phenomena found in the prior-art rackets as referred to above are at least substantially reduced.

Yet another object of the present invention is to provide a racket such as a tennis racket whose construction and dimensions are especially adapted to increase the accuracy of striking with the racket.

These and other objects are achieved in a racket comprising a handle, a racket head frame portion provided with stringing, and a shaft arrangement connecting the handle and the racket head frame portion, with the shaft arrangement including a throat region adjoining the racket head frame portion, wherein the resonance frequency of the stringed frame portion which is secured to the racket handle is approximately adapted to the period of time for which the ball remains in contact with the stringing in use of the racket. Preferably, in accordance with the present invention, the fundamental or natural frequency of the racket substantially coincides with the excitation frequency of the ball, and is preferably from about 70 to 200 Hz, more preferaby from 100 to 140 Hz. The ball contact time is from about 2.5 to 7 ms, for half an oscillation. It is found that a racket in accordance with the invention enjoys substantially improved striking accuracy and performance.

In accordance with the principles of this invention, the racket which is the same as known rackets insofar as the racket head frame portion thereof, or a frame bar member forming the racket head frame portion, is of a cross-sectional width, as measured in the plane of the stringing, of between 8 to 16 mm, has a moment of inertia which is from 4 to 16 times higher than that of a tennis racket in accordance with the prior art, the cross-sectional height of which, as measured in a plane normal to the plane of the stringing, is equal to or less than the thickness of its handle as measured in the same direction.

Further in accordance with the invention is a racket having a handle which, without wrapping or cladding material thereon and disregarding the handle end cap member, is of a conventional thickness of about 23 to 32 mm, with the axis of the racket forming a straight line of symmetry, while the height of a cross-section of the frame portion, as measured in a direction normal to the plane of the stringing therein, is greater than the above-mentioned thickness of the handle. The thickness of the handle is set by the size of the human hand and therefore remains within certain constant limits, without therefore having any effect on the configuration of the racket. In accordance with a further feature of this invention, the above-indicated ratio in respect of the thickness of the handle to the height of a cross-section of the racket head frame portion also applies in regard to a frame bar member from which the racket head frame portion is produced and which extends beyond the racket head frame portion, from the throat region thereof to the handle where it is fixedly connected thereto.

A preferred maximum height in respect of the cross-section of the racket head frame portion and/or a bar member forming same has been found to be a measurement of greater than the thickness of the handle up to about 45 mm.

In accordance with the invention, the height of the cross-section of the racket or more particularly the racket head frame portion thereof, as measured in a direction normal to the plane of the racket stringing, increases relative to the thickness of the handle either abruptly or progressively, and may decrease again from the point of maximum dimension towards the head end of the racket, that is to say, the end remote from the handle thereof, with the reduction in dimension again being either abrupt or progressive.

Thus, it has been found desirable for the racket to be of its maximum height (as measured in a direction normal to the plane of the stringing) in the throat region, and to taper both towards the handle end and towards the head end of the racket, that is to say, in both directions along the longitudinal axis of the racket; the maximum height of the racket is preferably constant over a portion which extends on both sides of the throat region of the racket.

In accordance with a further feature of the invention, the maximum height of the racket is disposed at the transition between the shaft arrangement of the racket and the handle, wherein the height of the racket or its cross-section may decrease from that transitional location or at a spacing therefrom, towards the head end of the racket. The reduction in dimension may be progressive, producing a straight-lined longitudinal contour, but it is also possible for the longitudinal contour to be of a curved or progressively varying configuration.

A consideration which is of particular significance in regard to a preferred embodiment of a racket according to the invention is the configuration of the throat region, in the form of a narrow frame portion whose height (as measured in the direction normal to the plane of the stringing) is less than the corresponding height of the bar member forming the racket head frame portion.

Where reference is made hereinbefore and also hereinafter to a cross-sectional dimension, it should be borne in mind that the longitudinal axis of the racket is also an axis of symmetry, that is to say, in opposite relationship to the cross-section referred to, on the other side of the axis of symmetry of the racket, is another, corresponding cross-section. In addition, in accordance with a feature of the invention, the stringing of the racket represents or defines a plane of symmetry.

Further features, details and advantages of a racket in accordance with the principles of this invention will be apparent from the following description of preferred embodiments thereof and the accompanyng drawing.

DESCRIPTION OF PREFERRED EMBODIMENTS

Figure 1:
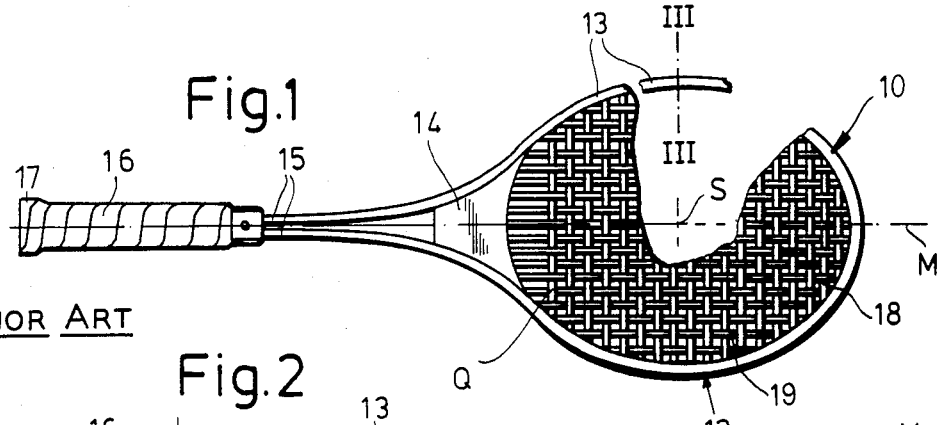
Fig.1 PRIOR ART
FIG. 1 is a partly broken-away plan view of a known tennis racket with a frame made from shaped tubing.
Figure 2:
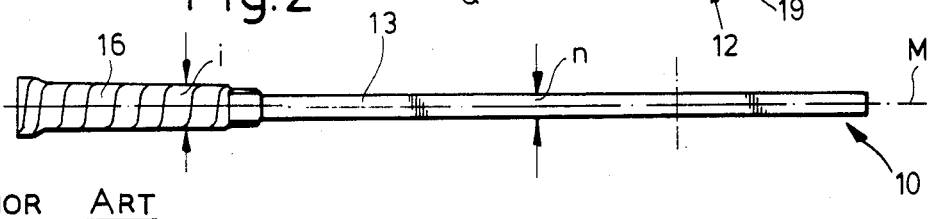
Fig.2 PRIOR ART
FIG. 2 is a side view of the racket shown in FIG. 1.
Figure 3:
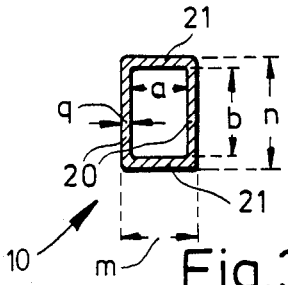
Fig.3 PRIOR ART
FIG. 3 is a view in cross-section taken along line III—III in FIG. 1, on an enlarged scale.

Referring firstly to FIGS. 1 through 3, shown therein by way of example is a tennis racket of known kind, as indicated generally by reference numeral 10. The racket 10 comprises an at least generally oval stringing frame portion or racket head 12 comprising a suitably curved bar or tube member as indicated at 13 which, on both sides of the longitudinal axis of the racket as indicated by M, terminates in arms 15 which define the shaft arrangement of the racket and which delimit a throat portion 14 of a plate-like configuration. The arms 15 are fixed in a handle 16 which is of a thickness i (as shown in FIG. 2) of from 26 to 32 mm; the thickness i is measured at the handle 16 without any wrapping or cladding leather thereon and disregarding a handle end cap member as shown at 17 in FIG. 1.

The racket head frame portion 12 and the throat portion 14 define a stringing area as indicated by Q in FIG. 1, comprising transverse strings 18 and longitudinal strings 19 crossing the strings 18. The preferred point of impact for a tennis ball (not shown), which is sometimes referred to as the sweet spot, is denoted by S in FIG. 1.

The frame portion 12 or the bar member 13 forming same are of generally square or rectangular cross-section as shown for example in FIG. 3, comprising side walls 20 which are disposed for example at a spacing as indicated by a of 7 mm, while transverse walls 21 thereof are disposed at a spacing b of 17 mm.

With the gauge q of the walls 20 and 21 of the frame portion being 2 mm, the external width of the frame structure as illustrated in FIG. 3 and denoted by m therein is 11 mm while the external height as indicated by n is 21 mm. The latter is much less than the thickness i of the handle 16.

The cross-sectional area for the member 13, which can be calculated from the foregoing measurements, is, in square millimeters, 112 $mm^2$.

Figure 5:
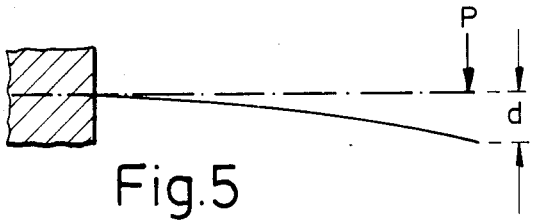
FIG. 5 is a diagram showing a condition of loading.

The natural or inherent frequency fo of the tennis racket 10 when in a gripped condition at its handle, as shown in FIG. 5, can be measured by suddenly removing a force indicated at P in FIG. 5, which acts on the racket at the longitudinal axis M thereof.

If the natural frequency is plotted on a tape moving at a speed of 3000 mm/s, that gives:

$$f_0 = 3000/l \text{ (Hz)}$$

wherein l is the length of oscillation in mm as read off from the tape.

The contact time as between a tennis racket 10 and the ball was established by a large number of tests, inter alia by means of high speed photography, as being from 2 to a maximum of 7 ms, being therefore on average around 4 ms, which gives for a complete oscillation t=8 ms, or 125 Hz.

Figure 4:
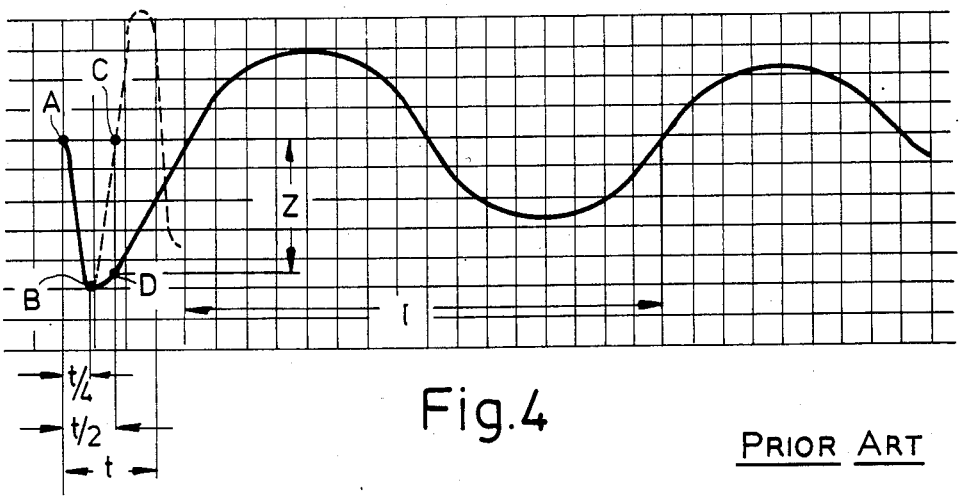
Fig.4 PRIOR ART
FIG. 4 is an oscillation diagram in respect of the tennis racket shown in FIGS. 1 through 3.

FIG. 4 shows an oscillation curve in the longitudinal direction in respect of a conventional tennis racket 10 as shown in FIGS. 1 through 3. At point A, a ball strikes the meshing of the stringing Q and forces the racket head frame portion 12 to follow the ball frequency. Dynamic inertia forces of the racket head frame portion 12 seek to oppose such movement. When point B is reached, the ball reverses its direction of movement and leaves the stringing Q, which follows the ball, approximately at point C. The tennis racket 10 continues to oscillate at its natural frequency and is only at point D when the ball comes away from the stringing Q at point C (t=8 ms, t/4=2 ms).

The different values in respect of the natural frequency of the tennis racket 10, of from 25 to 50 Hz on the one hand, and the excitation frequency of the ball of about 125 Hz on the other hand, result, over the full length of a court, in significant deviations of the ball from the desired line of flight thereof; as mentioned above, such deviations may be up to around a meter.

Figure 6:
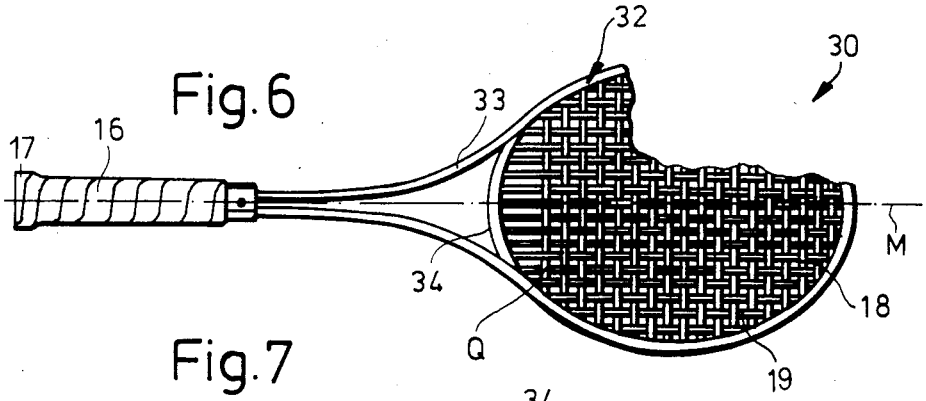
FIG. 6 is a plan view of part of a preferred embodiment of a tennis racket in accordance with this invention, with its strung frame.
Figure 7:
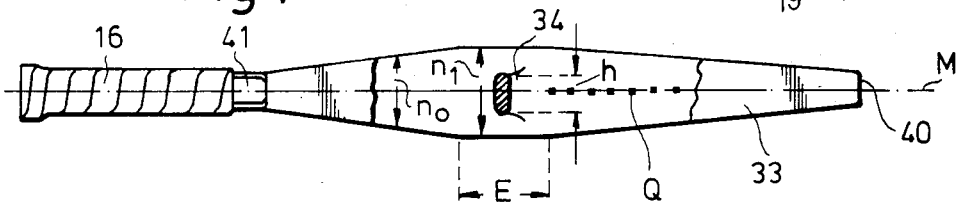
FIG. 7 is a view corresponding to that shown in FIG. 2, of the racket shown in FIG. 6.
Figure 8:
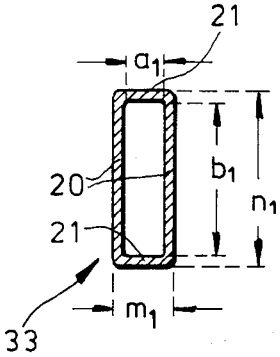
FIG. 8 is a view in cross-section through the frame structure of the racket according to the invention.

Referring now to FIGS. 6 through 8, shown therein is a tennis racket in accordance with the principles of this invention, as denoted generally by reference numeral 30. The tennis racket 30 has a resonance frequency which at least tends to remedy the above-mentioned defect in the known racket. The cross-section of the bar member 33 forming the frame of the racket, as shown in FIG. 8, is of the following dimensions:

internal width $a_1$: 8 mm
external width $m_1$: 10 mm
internal height $b_1$: 32.2 mm
external height $n_1$: 37 mm.

Those dimensions were found as the result of a calculation which confirms coincidence as between the natural frequency of the tennis racket 30 and the 'ball resonance', that is to say, coincidence as between excitation frequency and natural frequency.

The cross-sectional area which can be calculated is in this case also calculates to 112 $mm^2$ and is therefore equal to the cross-sectional area of the tennis racket 10.

$$FR_{30} = FR_{10}\sqrt{\frac{1}{0.18}} = FR_{10}\sqrt{5.55}$$

$$FR_{30} = FR_{10}\,2.36 \cong 120 \text{ Hz}$$

FIG. 7 reproduces a frame configuration which takes account of the foregoing considerations. In FIG. 7, a region E has the height $n_1$ of the frame structure projecting, on both sides of a frame member 34 which extends across the throat portion of the racket, as can be best seen from FIG. 6. From the region E, the height $n_o$ progressively decreases towards the head end 40 of the racket frame on the one hand and towards the handle attachment point as indicated at 41. The frame member 34 which is shown in cross-section in FIG. 7 replaces the throat plate member 14 which was described hereinbefore with reference for example to FIG. 1, and is of a smaller mean height as indicated at h in FIG. 7, than the frame bar member 33.

Figure 9:
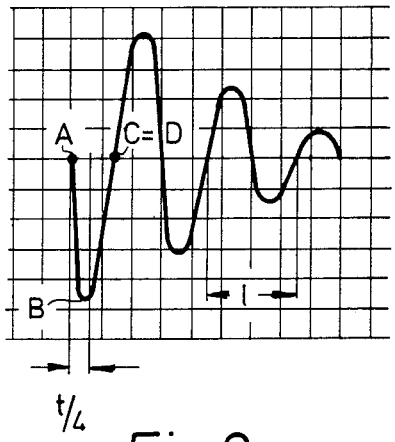
FIG. 9 is an oscillation diagram is respect of the racket shown in FIGS. 6 through 8, FIGS. 10 through 12 show diagrammatic side views of selected, preferred embodiments of a tennis racket according to the invention.

The oscillation performance of the tennis racket 30 according to the invention, in the longitudinal direction thereof, is shown in FIG. 9. The excitation frequency of the ball is now the same as the natural frequency of the racket. When the ball leaves the stringing Q, the racket 30 is at point C or has reached the direct vicinity thereof, and, besides receiving additional acceleration, from the frame portion 32 of the tennis racket 30, the ball also receives a precise trajectory which is no longer falsified by the degree of deflection as indicated by Z in FIG. 4. In the case of balls which impinge on the tennis racket 30 or the stringing Q thereof inaccurately, that is to say, off the longitudinal axis M thereof, there is a torsional or twisting oscillation about the longitudinal axis M, which is superimposed on the longitudinal oscillation. If that oscillation is also adjusted to a preferred value of 125 Hz by adapting the frame member 34 shown in FIG. 7, the entire tennis racket 30, upon making contact with the ball, oscillates only with a sinusoidal pattern at one frequency and also compensates for deviations in the line of striking of the ball, due to the twisting effect, by virtue of a return oscillation in good time.

The handle 16 of the tennis racket 30 as shown in FIGS. 6 through 8 and the handles of the embodiments $30_a$ to $30_c$ as shown in FIGS. 10 through 12*a* are of conventional thickness i, which, as stated above, is from 23 to 32 mm, while in comparison with that thickness i, the adjoining frame bar members (because of their fluctuating heights, they are better referred to generally as frame members 33), are of a greater external height as indicated by $n_1$, in all cases.

Figure 10:
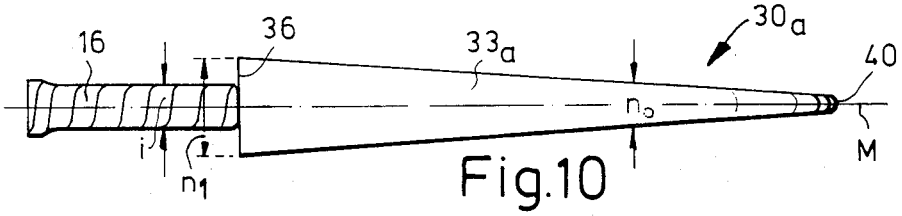

In FIG. 10, the increased external height $n_1$ occurs at the transitional portion 36, which is an abrupt transition, between the handle 16 and the frame member 33*a* which then steadily tapers to the head end 40 of the racket head frame portion, as indicated by the height $n_o$.

Figure 11:
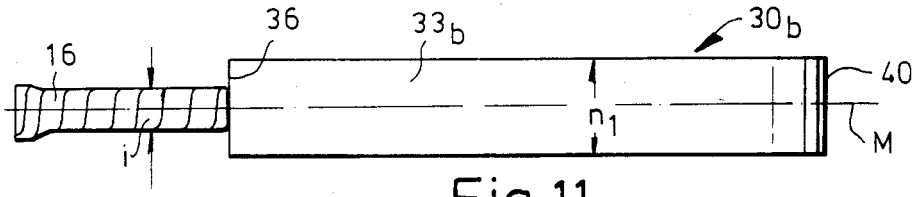
Figure 12:
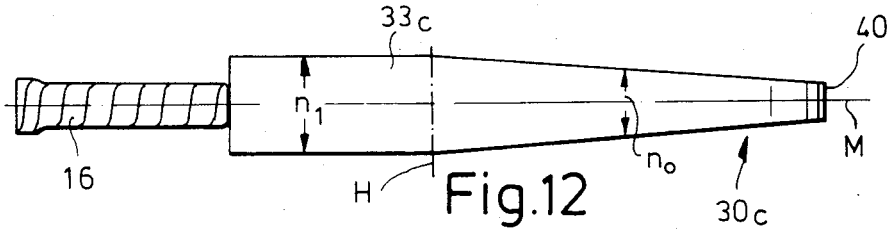
FIG. 12*a* shows a modified embodiment of the FIG. 12 construction.
Figure 12A:
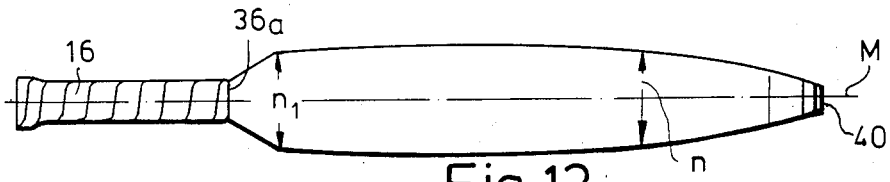

The frame member 33*b* shown in FIG. 11 is overall of that maximum height $n_1$, while the maximum height $n_1$ of the frame member 33*c* shown in FIG. 12 terminates approximately at the throat region as indicated by the dash-dotted line H, and then decreases, as indicated by height $n_o$, to the head end 40 of the racket head frame portion.

The embodiments of the racket in accordance with this invention, as shown for example in FIGS. 10 through 12, have a frame defined by straight lines extending from the point of maximum height as indicated by $n_1$, so that they are either of a straight-sided configuration as shown in FIG. 11 or have a progressive reduction in the variable dimension $n_o$ as shown for example in FIGS. 10 and 12. Instead of that straight-lined configuration however, the corresponding cross-sectional configurations could also be curved as shown by way of example in FIG. 12*a* where the frame progressively decreases towards the racket head end 40, but with a curved outline as is clearly apparent.

Various other modifications and alterations may be made in the above-described embodiments of this invention without thereby departing from the spirit and scope thereof.

What is claimed is:

1. A tennis racket for use with a tennis ball having a longitudinal axis which comprises a handle, a frame portion defined by a frame member having an annular opening, stringing on said frame member covering said annular opening, shaft members depending from the frame member and including a transition from the shaft members to the handle, a throat member extending between the shaft members and forming a base of the frame portion, said throat member and said shaft members defining a throat region, said handle being connected to the shaft members in the longitudinal axis of the racket forming a straight line of symmetry, wherein the cross-sectional height of said shaft members as measured in a direction perpendicular to the plane of the stringing is greater than the parallel thickness of each of the frame member and handle, and wherein the resonance frequency of said frame portion at least approximately corresponds to the period of time for which a standard new tennis ball is in contact with the stringing.

2. A racket according to claim 1 wherein its said resonance frequency is from 70 to 200 Hz.

3. A racket according to claim 2 wherein said resonance frequency is from 100 to 140 Hz.

4. A racket according to claim 2 having a cross-sectional width of from 8–16 mm as measured in the plane of the stringing with respect to the frame member, wherein the moment of inertia of the cross-section of the frame portion is from about 4 to 16 times the moment of inertia of a racket whose cross-sectional height is at most equal to the thickness of the handle.

5. A racket according to claim 1 wherein the frame member is formed by a bar member having a rectangular cross-section.

6. A racket according to claim 1 wherein the dimension of the handle as measured in a direction normal to the plane of said stringing is about 23–32 mm.

7. A racket according to claim 6 wherein said frame portion dimension decreases in accordance with a curved contour.

8. A racket according to claim 1 wherein the maximum dimension of said racket as measured in a direction normal to the plane of said stringing is at the transition to the handle.

9. A racket according to claim 1 wherein it is of its maximum height as measured in a direction normal to the plane of said stringing in said throat region and tapers both towards said handle and towards the end of said frame portion which is remote from said handle.

10. A racket according to claim 9 wherein said taper is progressive.

11. A racket according to claim 9 including a region of maximum height extending on both sides of said throat region.

12. A racket according to claim 1 wherein the dimension of said throat member as measured in a direction normal to the plane of said stringing being less than the corresponding dimension of said member defining said frame portion.

13. A racket according to claim 1 wherein said stringing is a plane of symmetry.

14. A racket according to claim 1 wherein said throat region comprises an open throat region which is defined by sections of the shaft members meeting towards the handle and by the throat member, wherein the mean shaft height of the throat member is smaller than the height of the shaft member.

15. A racket according to claim 14 wherein the cross-sections of the greatest height of the shaft member are provided on both sides of the throat member.

16. A racket according to claim 1 wherein said height decreases in a constant manner outside the area of greatest height.

* * * * *